US011415379B2

(12) United States Patent
Nishida et al.

(10) Patent No.: US 11,415,379 B2
(45) Date of Patent: Aug. 16, 2022

(54) SEAL STRUCTURE FOR HEAT EXCHANGER AND HEAT EXCHANGER

(71) Applicant: MITSUBISHI HITACHI POWER SYSTEMS, LTD., Kanagawa (JP)

(72) Inventors: Shingo Nishida, Tokyo (JP); Satoshi Hiraoka, Yokohama (JP); Kenji Kirihara, Kanagawa (JP); Hideyuki Morita, Tokyo (JP)

(73) Assignee: MITSUBISHI HEAVY INDUSTRIES, LTD., Tokyo (JP)

( * ) Notice: Subject to any disclaimer, the term of this patent is extended or adjusted under 35 U.S.C. 154(b) by 104 days.

(21) Appl. No.: 16/651,019

(22) PCT Filed: Jul. 25, 2018

(86) PCT No.: PCT/JP2018/027915
§ 371 (c)(1),
(2) Date: Mar. 26, 2020

(87) PCT Pub. No.: WO2019/064866
PCT Pub. Date: Apr. 4, 2019

(65) Prior Publication Data

US 2020/0271399 A1 Aug. 27, 2020

(30) Foreign Application Priority Data

Sep. 29, 2017 (JP) ..... JP2017-191042

(51) Int. Cl.
*F28F 9/22* (2006.01)
*F28F 9/24* (2006.01)
(Continued)

(52) U.S. Cl.
CPC ..... *F28F 9/24* (2013.01); *F28D 7/10* (2013.01); *F28D 7/16* (2013.01); *F28F 1/38* (2013.01);
(Continued)

(58) Field of Classification Search
CPC ..... F28F 9/22; F28F 2230/00; F28F 9/005; F28D 7/1607
See application file for complete search history.

(56) References Cited

U.S. PATENT DOCUMENTS 1,803,035 A * 4/1931 Potter ..... F28F 9/22 165/DIG. 411
4,215,745 A 8/1980 Tuckmantel
(Continued)

FOREIGN PATENT DOCUMENTS

CN 2468001 12/2001
CN 101986090 3/2011
(Continued)

OTHER PUBLICATIONS

Office Action dated Jul. 13, 2021 in German Application No. 112018005012.2 with English translation thereof.
(Continued)

*Primary Examiner* — Eric S Ruppert
(74) *Attorney, Agent, or Firm* — Wenderoth, Lind & Ponack, L.L.P.

(57) ABSTRACT

In a seal structure for a heat exchanger, the seal structure being mounted on a baffle plate disposed in a shell included in the heat exchanger and being partially in contact with a wall surface on an inner surface side of the shell, the seal plate is composed of a plurality of thin plates which are laminated; the thin plates are in contact with the wall surface while being curved by an elastic deformation; a contact thin plate serving as one of the thin plates located on an outermost side of the curve is in contact with the wall surface; and an outer surface of the contact thin plate serving as a surface on an outside of the curve among surfaces arranged in a
(Continued)

thickness direction of the contact thin plate is in contact with the wall surface so as to restrain seal performance from deteriorating.

6 Claims, 12 Drawing Sheets

(51) Int. Cl.

| | |
|---|---|
| ***F28D 7/10*** | (2006.01) |
| ***F28D 7/16*** | (2006.01) |
| ***F28F 1/38*** | (2006.01) |
| ***F28F 9/10*** | (2006.01) |
| ***F28F 9/00*** | (2006.01) |

(52) U.S. Cl.
CPC ..... *F28F 9/005* (2013.01); *F28F 9/10* (2013.01); *F28F 9/22* (2013.01); *F28F 2230/00* (2013.01)

(56) References Cited

U.S. PATENT DOCUMENTS 5,042,432 A * 8/1991 Marjollet ..... F22G 1/005 122/483
5,447,195 A 9/1995 Luyts
2006/0076126 A1* 4/2006 Fandry ..... F28D 7/06 165/159
2015/0322807 A1* 11/2015 Budnick ..... F02C 7/28 277/654

FOREIGN PATENT DOCUMENTS

| | | |
|---|---|---|
| EP | 2717010 | 4/2014 |
| JP | 49-115759 | 10/1974 |
| JP | 60-105988 | 7/1985 |
| JP | 62-118977 | 7/1987 |
| JP | 02-127985 | 10/1990 |
| JP | 7 -71893 | 3/1995 |
| JP | 08-105386 | 4/1996 |

OTHER PUBLICATIONS

Written Opinion dated Oct. 16, 2018 in corresponding International (PCT) Application No. PCT/JP2018/027915; with English Translation.
International Search Report dated Oct. 16, 2018 in corresponding International (PCT) Application No. PCT/JP2018/027915.
Office Action dated Nov. 24, 2020 in Chinese Patent Application No. 201880062700.X, with English Translation.

* cited by examiner

SEAL STRUCTURE FOR HEAT EXCHANGER AND HEAT EXCHANGER

FIELD

The present invention relates to a seal structure for a heat exchanger provided with a baffle plate, and to the heat exchanger.

BACKGROUND

Conventional multi-tube heat exchangers have been variously elaborated to ensure sealability between a shell provided therein with heat transfer tubes and a baffle mounted inside the shell. For example, in a gap between a shell and a baffle of a multi-tube heat exchanger described in Patent Literature 1, a seal plate including laminated thin plates of, for example, stainless steel is mounted by, for example, being bolted to the baffle so as to be capable of easily reducing leakage of a fluid from the gap.

CITATION LIST

Patent Literature

Patent Literature 1: Japanese Unexamined Utility Model Application Publication No. 60-105988

SUMMARY

Technical Problem

The seal plate has elasticity. Therefore, when spaces separated by the baffle in the shell have a pressure difference therebetween, the seal plate is deformed in a direction pushed from a higher pressure side to a lower pressure side. Hence, when the pressure difference between spaces separated by the baffle is large, the seal late is greatly deformed by the large pressure difference in the direction pushed from the higher pressure side to the lower pressure side. If the pressure difference causes the deformation of the seal plate as described above, and then, the heat exchanger stops operating, the elasticity causes the seal plate to return to an original state before being deformed. However, if the seal plate is greatly deformed by the large pressure difference between the spaces separated by the baffle while the heat exchanger is in operation, the seal plate may be difficult to restore an original shape when the heat exchanger stops operating to return the seal plate to the original state before being deformed.

In other words, to ensure the sealability with respect to a wall surface on an inner surface side of the shell, the seal plate is in contact with the wall surface in a state in which the elasticity applies pressing force to the wall surface, and therefore, is deformed while sliding with respect to the wall surface when being deformed by the pressure difference between the spaces separated by the baffle. Specifically, the seal plate is deformed while, of the thin plates laminated to constitute the seal plate, a thin plate located on a side closest to the wall surface and being in contact with the wall surface slides with respect to the wall surface. If the pressure difference between the spaces separated by the baffle is relatively small such that the deformation of the seal plate is small, the elasticity causes the seal plate to return to the original shape before being deformed when the heat exchanger has stopped operating after the seal plate has been deformed while sliding with respect to the wall surface as described above.

However, if the pressure difference between the spaces separated by the baffle is so large that the deformation of the seal plate is large, a corner at an end of the thin plate located on the side closest to the wall surface and being in contact with the wall surface may be caught on the wall surface, and this thin plate alone may be turned up without being restored to the original shape. Such turning up of the thin plate may be worsened with the large deformation of the seal plate caused by the large pressure difference when the heat exchanger repeats starting and stopping. In this case, the number of the laminated thin plates of the seal plate decreases, and consequently, the seal performance may deteriorate to make it easy to cause the leakage of the fluid.

The present invention has been made in view of the above, and an object thereof is to provide a seal structure for a heat exchanger and the heat exchanger capable of restraining the seal performance from deteriorating.

Solution to Problem

To solve the problems described above and achieve the object, a seal structure for a heat exchanger according to the present invention has a seal plate to be mounted on a baffle plate disposed in a shell included in the heat exchanger and is partially in contact with a wall surface on an inner surface side of the shell. The seal plate is composed of a plurality of thin plates which are laminated. The thin plates are in contact with the wall surface while being curved by elastic deformation. A contact thin plate serving as one of the thin plates located on an outermost side of the curve is in contact with the wall surface. An outer surface of the contact thin plate serving as a surface on an outside of the curve among surfaces arranged in a thickness direction of the contact thin plate is in contact with the wall surface.

In the seal structure for a heat exchanger, it is preferable that a length from a mounting position onto the baffle plate to an end of the contact thin plate located on the wall surface side is longer than a length from the mounting position onto the baffle plate to an end on the wall surface side of each of at least some of the thin plates other than the contact thin plate, and pressing force in a direction toward the wall surface is applied from the thin plates other than the contact thin plate into a position other than the end of the contact thin plate in the seal structure for a heat exchanger, it is preferable that the wall surface is provided with a convex part projecting from the wall surface, and the outer surface of the contact thin plate of the seal plate is in contact with the convex part.

In the seal structure for a heat exchanger, it is preferable that a concave part recessed from the wall surface is formed on the wall surface, and the outer surface of the contact thin plate of the seal plate is in contact with a peripheral end of the concave part.

In the seal structure for a heat exchanger, it is preferable that an end side of the contact thin plate located on the wall surface side is folded back toward a side opposite to a side where the outer surface is located so as to make the outer surface in contact with the wall surface.

In the seal structure for a heat exchanger, it is preferable that a deformation restraining member configured to restrict the contact thin plate from being deformed toward the outside direction of the curve is laminated and mounted on the outer surface side of the contact thin plate of the seal plate.

Further, a heat exchanger according to the present invention includes a baffle plate; a shell in which the baffle plate is disposed; and the seal structure that is mounted on the baffle plate and closes a gap between a wall surface of the shell and the baffle plate in the shell.

Advantageous Effects of Invention

A seal structure for a heat exchanger and the heat exchanger according to the present invention provides an effect of being capable of restraining the seal performance from deteriorating.

DESCRIPTION OF EMBODIMENTS

The following describes embodiments of a seal structure for a heat exchanger and the heat exchanger according to the present disclosure in detail based on the drawings. The embodiments do not limit the present invention. Components in the embodiments described below include those replaceable and easily conceivable by those skilled in the art, or those substantially identical thereto.

First Embodiment

Figure 1:
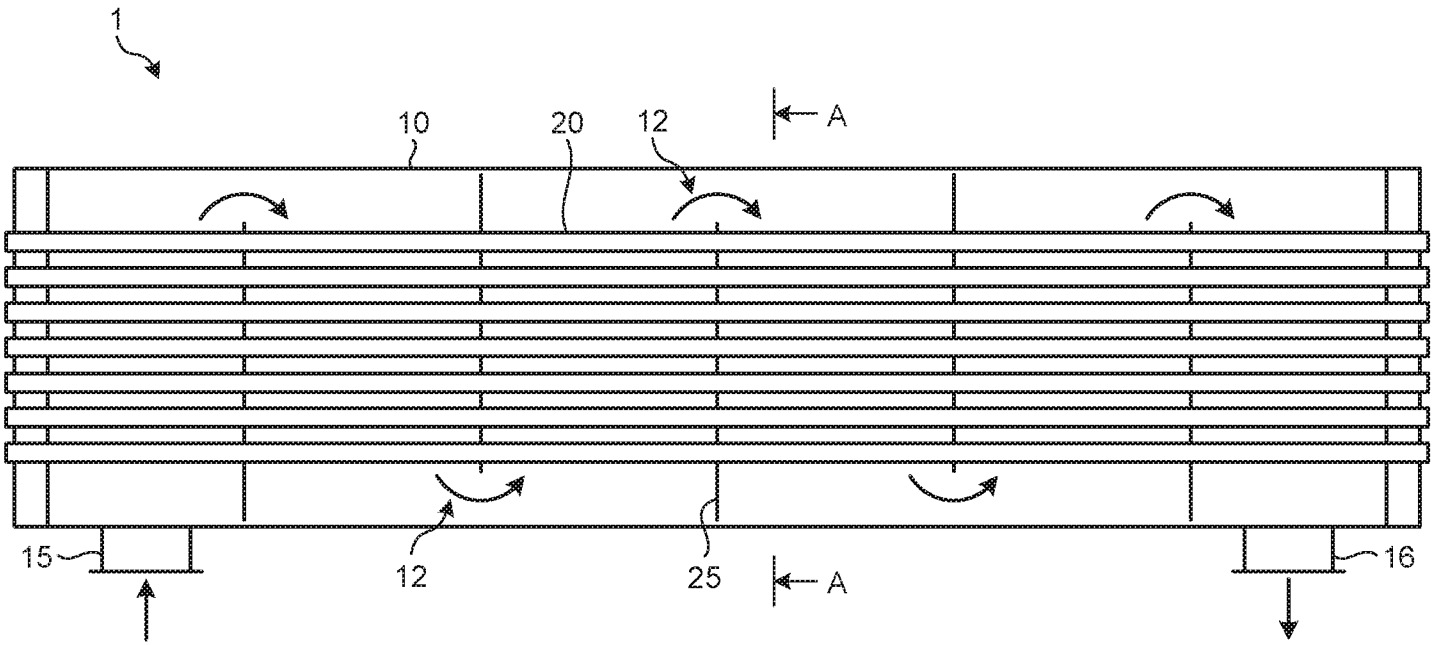
FIG. 1 is a sectional schematic view of a heat exchanger according to a first embodiment of the present invention.

FIG. 1 is a sectional schematic view of a heat exchanger 1 according to a first embodiment of the present invention. The heat exchanger 1 according to the first embodiment includes a shell 10 formed into a substantially cylindrical shape, a heat transfer tube 20 that exchanges heat with a fluid flowing in the shell 10, and a baffle plate 25 that holds the heat transfer tube 20 and regulates the flow of the fluid flowing in the shell 10. Of the above-described components, the shell 10 is provided, near an end thereof in an axial direction of a cylinder that is the shape of the shell 10, with an inlet port 15 serving as an entrance of the fluid to flow in the shell 10 into the shell 10. The shell 10 is provided, near the other end thereof, an outlet port. 16 serving as an exit of the fluid flowing in the shell 10 outside the shell 10. In the following description, the axial direction of the cylinder that is the shape of the shell 10 is also called a longitudinal direction of the shell 10.

The heat transfer tube 20 is formed into a tubular shape in which the fluid flows, and has a diameter much smaller than that of the shell 10. A plurality of the heat transfer tubes 20 are arranged in the shell 10. The heat transfer tubes 20 are arranged so as to extend from the one end side to the other end side in the longitudinal direction of the shell 10.

The baffle plate 25 is formed into a plate shape, and a plurality of the baffle plates 25 are arranged in the shell 10 such that the plate thickness direction corresponds to the longitudinal direction of the shell 10. The baffle plates 25 are arranged side by side with gaps therebetween in the longitudinal direction of the shell 10. The heat transfer tubes 20 penetrate the baffle plates 25 in the thickness direction thereof, and are held by the baffle plates 25.

Figure 2:
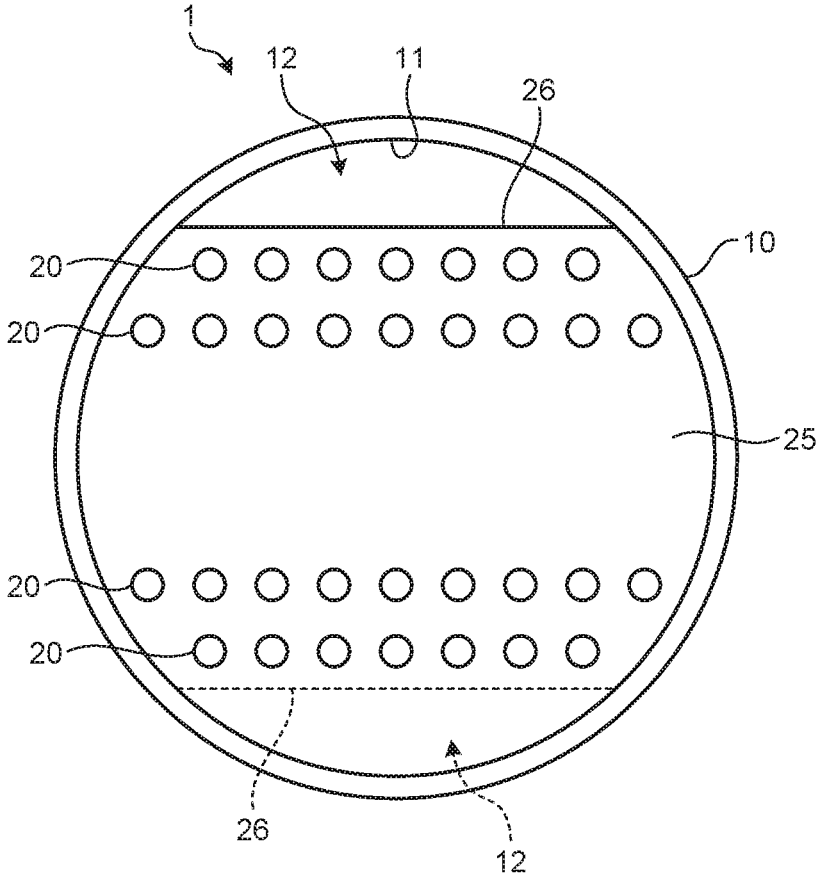
FIG. 2 is an A-A sectional view of FIG. 1.

FIG. 2 is an A-A sectional view of FIG. 1. The baffle plates 25 are each formed into a substantially circular shape with a part on the outer circumference thereof cut off when the shell 10 is viewed in the longitudinal direction of the shell 10, in other words, when the shell 10 is viewed in the thickness direction of the baffle plates 25. A cut out part 26 serving as a part partially cut out the outer circumference of the baffle plate 25 is formed into what is called a shape of a chord that is a line segment connecting two points on a circumference of a circle serving as the shape of the baffle plate 25. The baffle plate 25 formed into the substantially circular shape with the cut out part 26 formed thereon has a diameter of a circle comparable with an inside diameter of the substantially cylindrical shell 10 and slightly smaller than the inside diameter of the shell 10.

In other words, most part of the outer shape of the baffle plate 25 is formed into a shape along a wall surface 11 on an inner surface side of the shell 10, and the cut out part 26 portion of the baffle plate 25 is separated from the wall surface 11 of the shell 10. In the shell 10, a portion of the baffle plate 25 defined by the cut out part 26 and the wall surface 11 of the shell 10 is formed as a window part 12. The baffle plates 25 arranged in the longitudinal direction of the shell 10 are arranged such that positions of the cut out parts 26 of the adjacent baffle plates 25 are different from each other by approximately 180 degrees in the circumference direction. In other words, the window parts 12 formed by the adjacent baffle plates 25 are formed in positions different from each other by approximately 180 degrees in the circumferential direction of the shell 10 and the baffle plates 25.

Figure 3:
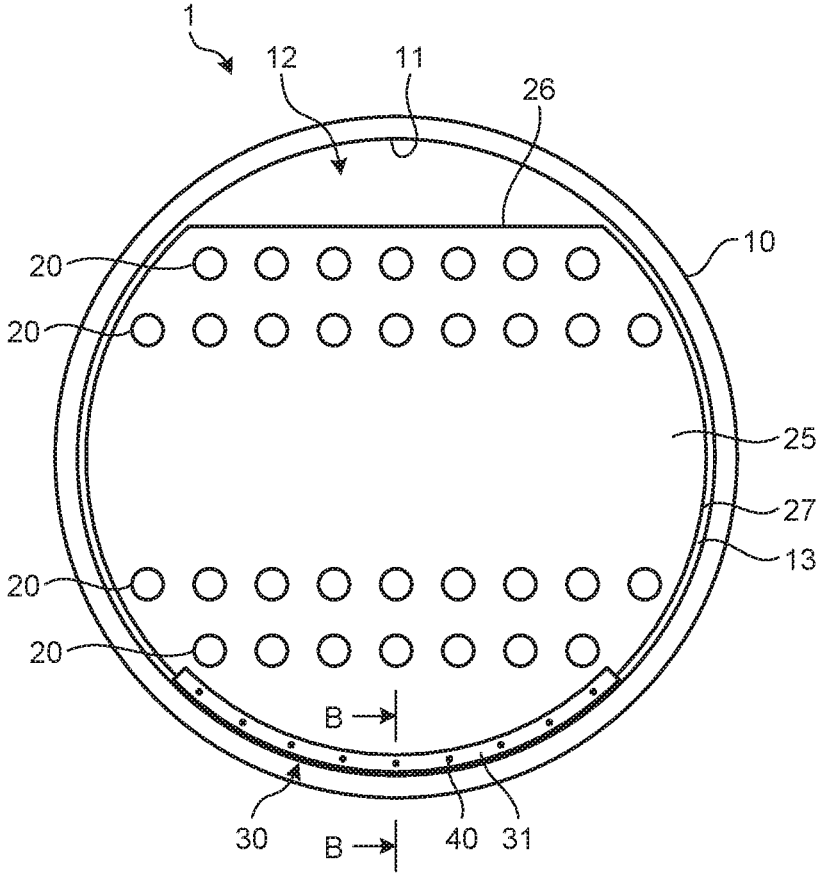
FIG. 3 is an A-A sectional view of FIG. 1, and is an explanatory view about a position for providing a seal plate.
Figure 4:
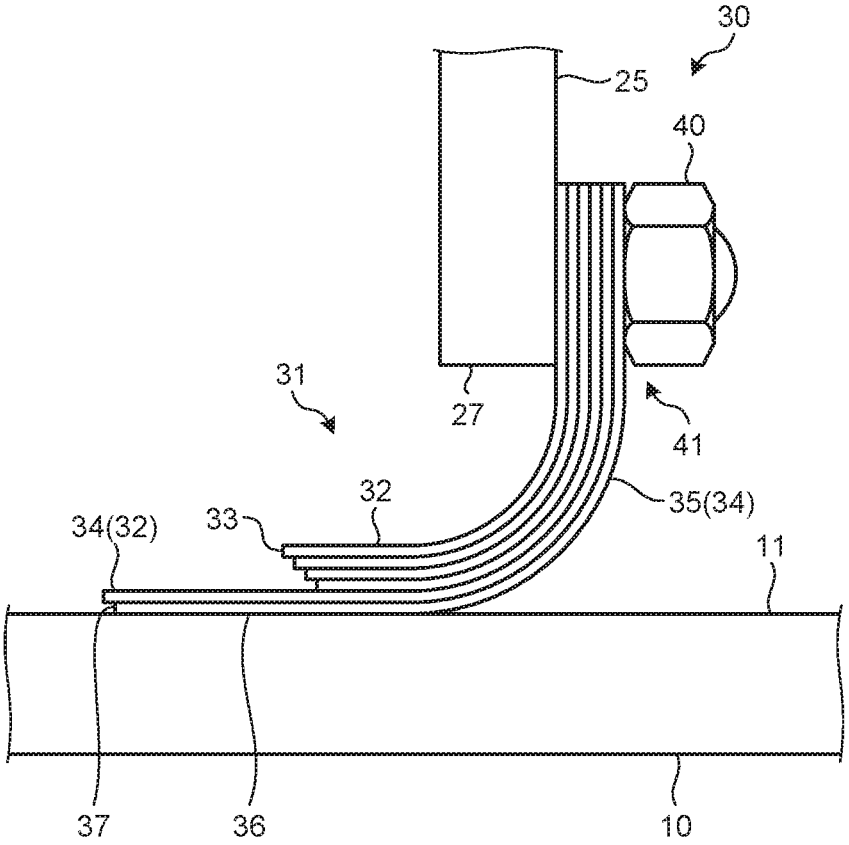
FIG. 4 is a B-B sectional view of FIG. 3.

FIG. 3 is an A-A sectional view of FIG. 1, and is an explanatory view about a position for providing a seal plate 31. FIG. 4 is a B-B sectional view of FIG. 3. A circumferential part 27 serving as a part of the outer circumference of the baffle plate 25 other than the cut out part 26 has a diameter slightly smaller than that of the wall surface 11 inside the shell 10. Consequently, a gap 13 is formed between the circumferential part 27 of the baffle plate 25 and the wall surface 11 of the shell 10. The inside of the shell 10 is provided with a seal structure 30 that is mounted on the baffle plate 25 and closes the gap 13 between the wall surface 11 of the shell 10 and the circumferential part 27 of the baffle plate 25. The seal structure 30 is configured by including the seal plate 31 at least partially in contact with the wall surface 11 on the inner surface side of the shell 10 and bolts 40 serving as mounting members for mounting the seal plate 31 on the baffle plate 25.

Of the above-described components, the seal plate 31 is mounted by the bolts 40 near the circumferential part 27 in a range on at least a part of the circumference of the circumferential part 27 of the baffle plate 25, and is formed so as to extend from the position of mounting on the baffle plate 25 to the side of the wall surface 11 of the shell 10. When an upstream side is a side in the longitudinal direction of the shell 10 where the inlet port 15 is located, and a downstream side is a side where the outlet port 16 is located, the seal plate 31 is mounted on a surface on the downstream side of the baffle plate 25. Therefore, when the baffle plate 25 is viewed from the downstream side thereof, the seal plate 31 is formed into a circular arc shape in a predetermined range along the circumferential part 27 at a predetermined width in a radial direction of the baffle plate 25.

As described above, the seal plate 31 to be mounted on the baffle plate 25 is composed of a plurality of thin plates 32 which are laminated and are each formed into a thin plate shape, and is mounted on the baffle plate 25 by the bolts 40 in a state in which the thin plates 32 are laminated, as illustrated in FIG. 4. For this purpose, through-holes (not illustrated) are formed in the thin plates 32 of the seal plate 31 to pass the bolts 40 therethrough, and screw holes (not illustrated) for screwing with the bolts 40 are formed in the baffle late 25. The thin plates 32 are interleaved between the bolts 40 and the baffle plate 25, and are tightened so as to mount the seal plate 31 on the baffle plate 25. A part of the seal plate 31 mounted on the baffle plate 25 serves as a tightened part 41 tightened by the bolts 40. In the tightened part 41, the thin plates 32 are laminated in the longitudinal direction of the shell 10.

The thin plates 32 are formed of, for example, a metal material such as stainless steel at a thickness of approximately 0.1 mm so as to have elasticity, and are in contact with the wall surface 11 while being curved by an elastic deformation. To describe it in detail, the thin plates 32 are curved from the surface on the downstream side of the baffle plate 25 where the seal plate 31 is mounted, toward the upstream side while being formed from the tightened part 41 serving as the position of mounting on the baffle plate 25 toward the wall surface 11 of the shell 10. Since the seal plate 31 is curved in this way, the thin plates 32 laminated in the longitudinal direction of the shell 10 in the position of the tightened part. 41 gradually change the direction of lamination thereof to a radial direction of the shell 10 as the thin plates 32 come closer to the wall surface 11 of the shell 10.

As a result, in the seal plate 31, a contact thin plate 35 serving as one of the thin plates 32 located on the outermost side of the curve is in contact with the wall surface 11. In other words, in the vicinity of a position of contact with the wall surface 11, the thin plates 32 are formed close in a state of being laminated with respect to the wall surface 11, so that the contact thin plate 35 that is located on the outermost side of the curve and closest to the wall surface 11 is in contact with the wall surface 11. Since the thin plates 32 contact the wall surface 11 of the shell 10 while being curved by the elastic deformation, the seal plate 31 comes in contact with the wall surface 11 while applying pressing force to the wall surface 11 using force to restore a flat-plate shape that is the original shape from the elastically deformed state.

In this case, "outside of the curve" refers to an outside in a radial direction of a curvature radius of the curve. In the same way, "inside of the curve" refers to an inside in the radial direction of the curvature radius of the curve.

Some of the thin plates 32 closer to the outside of the curve are long thin plates 34 having a larger length than the other thin plates 32 located inside of the curve relative to the former thin plates 32. In the first embodiment, two of the thin plates 32, including one located on the outermost side of the curve and the other adjacent to and laminated on the one thin plate 32, are provided as the long thin plates 34.

As a result, the contact thin plate 35 is also configured as one of the long thin plates 31, and a length from the position of the tightened part 41 to an end 37 of the contact thin plate 35 is longer than a length from the position of the tightened part 41 to an end 33 on the wall surface 11 side of each of at least some of the thin plates 32 other than the contact thin plate 35. The contact thin plate 35 is formed of the long thin plate 31 as described above, and therefore, has a wide range facing the wall surface 11 of the shell 10. When the contact thin plate 35 is in contact with the wall surface 11, an outer surface 36 of the contact thin plate 35 serving as a surface on the outside of the curve among surfaces arranged in a thickness direction of the contact thin plate 35 is in contact with the wall surface 11.

The position of the end 37 of the contact thin plate 35 in the longitudinal direction of the shell 10 is located on the upstream side of the positions of the ends 33 of the thin plates 32 other than the long thin plates 34. The ends 33 of the thin plates 32 other than the long thin plates 34 are located in a range in the longitudinal direction of the shell 10 where the contact thin plate 35 is disposed. Therefore, the pressing force applied toward the wall surface 11 by the elastic deformation of the thin plates 32 other than the contact thin plate 35 is applied to a position of the contact thin plate 35 other than the end 37 of the contact thin plate 35 located on the wall surface 11 side of the thin plates 32. In other words, since the seal plate 31 is curved by the elastic deformation of the thin plates 32, the thin plates 32 generate the pressing force from the seal plate 31 toward the wall surface 11. Therefore, the pressing force is applied from the thin plates 32 other than the long thin plates 34 toward the wall surface 11 to the position of the contact thin plate 35 other than the end 37 of the contact thin plate 35 that is located closer to the outside of the curve than the thin plates 32 other than the long thin plates 34 and is located on the upstream side of the thin plates 32 other than the long thin plates 34. Specifically, the pressing force by the elastic deformation is applied from the thin plates 32 other than the long thin plates 34 to a position of the contact thin plate 35 in the longitudinal direction of the shell 10 near the positions where the ends 33 of the thin plates 32 other than the long thin plates 34 are located.

The heat exchanger 1 according to the first embodiment has the above-described configuration, and a function thereof will be described below. The heat exchanger 1 is capable of exchanging heat between the fluid flowing from the inlet port 15 into the shell 10 and a fluid flowing in the heat transfer tubes 20. When the heat exchanger 1 performs the heat exchange, the fluid that exchanges the heat with the fluid flowing in the heat transfer tubes 20 is fed by, for example, a pump (not illustrated) to flow from the inlet port 15 into the shell 10. The fluid that has flowed into the shell 10 exchanges the heat with the fluid flowing in the heat transfer tubes 20, and then, flows out from the outlet port 16.

The baffle plates 25 form a plurality of spaces in the shell 10. In a case where the fluid in the shell 10 flows from the inlet port 15 side to the outlet port 16 side, when the fluid flows from a space on the upstream side separated by the baffle plates 25 to another separated space on the downstream side, the fluid flows into the space on the downstream side through the window part 12. At that time, since the window parts 12 formed by the adjacent baffle plates 25 are formed in positions different by 180 degrees in the circumferential direction of the baffle plates 25, the fluid that has entered a certain space from the window part 12 on the upstream side traverses the space in the radial direction of the shell 10, and then, flows from the window part 12 on the downstream side into the space on the downstream side. Through this operation, the fluid sequentially flows through perimeters of the heat transfer tubes 20 in each of the spaces separated by the baffle plates 25, and the heat exchange is efficiently performed.

As describe above, the fluid flowing in the shell 10 flows from the inlet port 15 side to the outlet port 16 side by being fed by, for example, the pump. Therefore, when pressure of the fluid in the spaces separated by the baffle plates 25 is compared between the upstream side and the downstream side of one of the baffle plates 25, the pressure is higher on the upstream side than on the downstream side. In addition to the window part 12, the gap 13 is formed between the baffle plate 25 and the shell 10. The fluid that would otherwise flow through the gap 13 from the space on the upstream side into the space on the downstream side is blocked by the seal plate 31 mounted on the baffle plate 25.

The seal plate 31 extends from a position thereof mounted on the baffle plate 25 toward the wall surface 11 on the inner surface side of the shell 10, and comes in contact with the wall surface 11 to close the gap 13. This configuration allows the seal plate 31 to block the flow of the fluid that would otherwise flow through the gap 13 from the upstream side to the downstream side.

The seal plate 31 is provided by being laminated with the thin plates 32. The thin plates 32 each have the elasticity, and contact the wall surface 11 of the shell 10 while being elastically deformed. Therefore, when the pressure of the fluid acts on the seal plate 31 while the heat exchanger 1 is in operation, the seal plate 31 is elastically deformed by differential pressure caused by a pressure difference between the upstream side and the downstream side of the baffle plate 25, and the amount of the elastic deformation increases with increase in the pressure difference. Since the differential pressure acting on the seal plate 31 is eliminated after the heat exchanger 1 stops operating, the seal plate 31 will be restored to the original shape. However, in a case of the conventional seal plate 31, if the differential pressure is so large that the elastic deformation of the seal plate is also large, any of the thin plates 32 constituting the seal plate 31 may be turned up without being restored to the original shape when the heat exchanger 1 has stopped operating.

Figure 5:
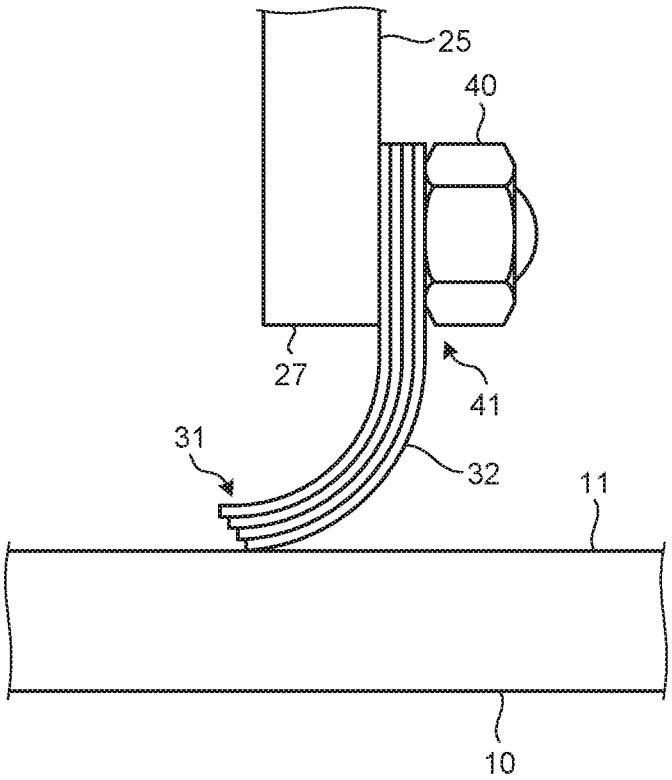
FIG. 5 is an explanatory view illustrating an example of a conventional seal plate.
Figure 6:
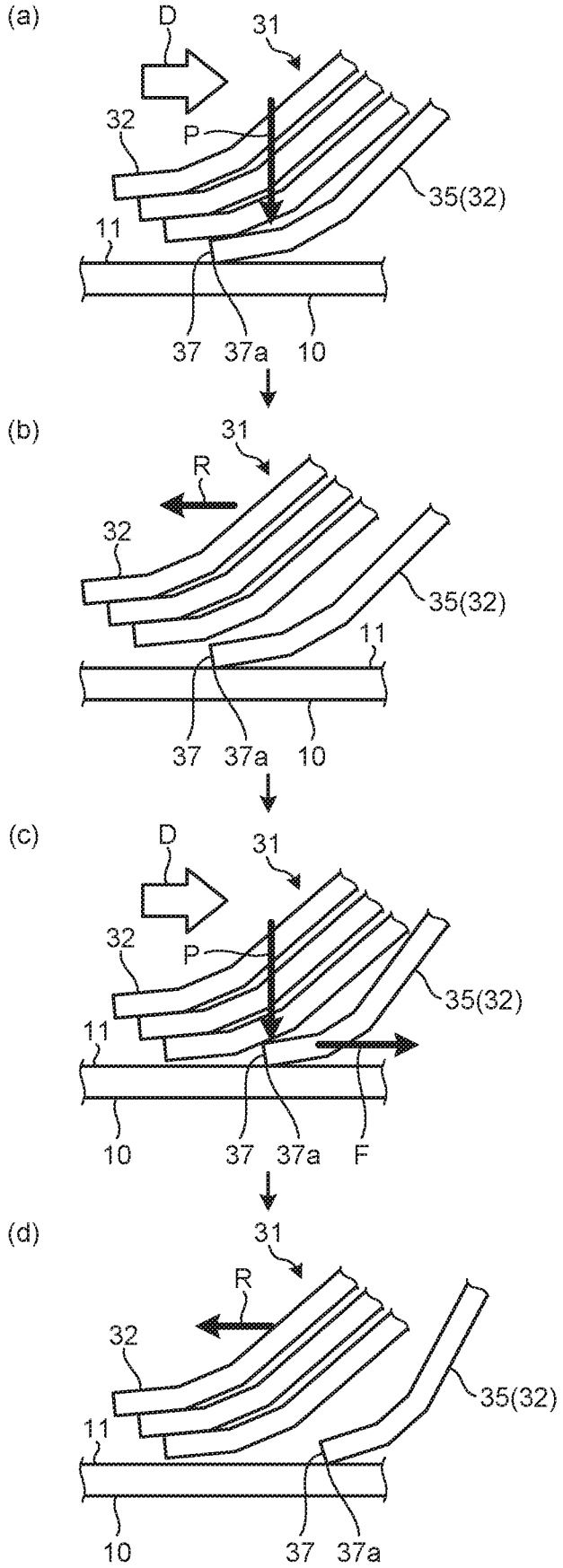
FIG. 6 is a transition diagram illustrating states of deformation associated with change in differential pressure acting on the seal plate illustrated in FIG. 5.

FIG. 5 is an explanatory view illustrating an example of the conventional seal plate 31. FIG. 6 is a transition diagram illustrating states of deformation associated with change in differential pressure D acting on the seal plate 31 illustrated in FIG. 5. The conventional seal plate 31 does not include the long thin plates 34 (refer to FIG. 4), and the thin plates 32 constituting the seal plate 31 all have the same length, as illustrated in FIG. 5. Since the seal plate Jr is mounted on the baffle plate 25 by elastically deforming the thin plates 32 into a curved shape, the seal plate 31 applies the pressing force to the wall surface 11 on the inner surface side of the shell 10 in the state in which the seal plate 31 is mounted on the baffle plate 25.

When the heat exchanger 1 with the seal late 31 mounted on the baffle plate 25 is operated, the pressure difference is generated between the space on the upstream side and the space on the downstream side separated by the baffle plate 25, and the pressure difference applies the differential pressure D from the upstream side to the downstream side to the seal plate 31. Since the seal plate 31 is mounted on the baffle plate 25 while being curved, the differential pressure D acting on the seal plate 31 acts as the force to deform the seal plate 31 toward the outside of the curve (FIG. 6(*a*)).

That is, one end side of the seal plate 31 mounted on the baffle plate 25, and this part is not moved by receiving the differential pressure D. Therefore, the differential pressure D acting on the seal plate 31 acts as the force to press the seal plate 31 onto the wall surface 11 of the shell 10 while moving a part of the seal plate 31 closer to the shell 10 from the upstream side to the downstream side. In other words, the differential pressure D acts to generate pressing force P to press the seal plate 31 toward the wall surface 11 of the shell 10 while deforming the part of the seal plate 31 closer to the shell 10 in the direction of the movement from the upstream side to the downstream side. Of the thin plates 32 constituting the seal plate 31, the contact thin plate 35 that is located on the outermost side of the curve and contacts the wall surface 11 of the shell 10 is made in contact with the wall surface 11 at a corner 37*a* of the end 37 by the pressing force P. As a result, the contact thin plate 35 contacts the wall surface 11 at high contact surface pressure. The pressing force P makes the seal plate 31 in close contact with the wall surface 11 at the corner 37*a* of the end 37 of the contact thin plate 35. As a result, the fluid in the space on the upstream side of the baffle plate 25 can be restrained from flowing into the space on the downstream side of the baffle plate 25 through the gap 13 between the baffle plate 25 and the wall surface 11.

Stopping the operation of the heat exchanger 1 eliminates the pressure difference between the spaces on both sides separated by the baffle plate 25. As a result, the differential pressure D stops acting also on the seal plate 31 (FIG. 6(*b*)). The seal plate 31 on which the differential pressure D acts is deformed in the direction from the upstream side toward the downstream side by the elastic deformation of the thin plates 32. Therefore, when the differential pressure D has stopped acting on the seal plate 31, the seal plate 31 will be restored to the original shape because of the elasticity of the thin plates 32. A restoring force R serving as the force with which the thin plates 32 will be restored to the original shape before being elastically deformed by the differential pressure D is generated in a direction in which the thin plates 32 are moved from the downstream side to the upstream side.

While the heat exchanger 1 is in operation, the contact thin plate 35 that contacts the wall surface 11 of the shell 10 is made in contact with the wall surface 11 at the corner 37*a* of the end 37 at the high surface pressure by the pressing force P based on the differential pressure D. As a result, the corner 37*a* may be caught on the wall surface 11. The restoring force R caused by stopping the differential pressure D from acting on the seal plate 31 is generated also in the contact thin plate 35. However, if the corner 37*a* of the end 37 is caught on the wall surface 11, the contact thin plate 35 is not restored to the original shape before being elastically deformed, and is kept in the state of being moved toward the downstream side by the differential pressure D. As a result, when the differential pressure D has stopped acting on the seal plate 31, the thin plates 32 other than the contact thin plate 35 are deformed in the direction in which the thin plates 32 are moved from the downstream side to the upstream side by the restoring force R, and restored to the original shape.

When the heat exchanger 1 having stopped operating operates again, the differential pressure D acts again on the seal plate 31, and the seal plate 31 is elastically deformed by the differential pressure D in the direction of moving from the upstream side to the downstream side. By this elastic deformation, the pressing force P is also generated (FIG.

6(*c*)). As a result, the contact thin plate 35 receives the pressing force P from the other thin plates 32 while being displaced with respect to the other thin plates 32, and receives pushing force F serving as the force in the direction of moving from the upstream side to the downstream side, from the other thin plates 32. As a result, the contact thin plate 35 is further elastically deformed in the direction of moving from the upstream side to the downstream side.

When the heat exchanger 1 has stopped operating again, and the differential pressure D acting on the seal plate 31 is eliminated, the thin plates 32 other than the contact thin plate 35 are moved in the direction from the downstream side to the upstream side by the restoring force R, and restored to the original shape before being elastically deformed (FIG. 6(*d*)). However, the contact thin plate 35 is caught on the wall surface 11 at the corner 37*a* of the end 37, and therefore, is kept in the state of being moved toward the downstream side by the differential pressure D, without being restored to the original shape before being elastically deformed. In that case, the resumed operation of the heat exchanger 1 moves the contact thin plate 35 from the original shape before being elastically deformed toward the downstream side by a large distance, and places the contact thin plate 35 in a state of being greatly separated from the thin plates 32 other than the contact thin plate 35.

As described above, in the case of the conventional seal plate 31, the end 37 of the contact thin plate 35 may be gradually moved toward the downstream side while being caught on the wall surface 11 of the shell by repeatedly operating and stopping the heat exchanger 1 that has a large pressure difference between the spaces separated by the baffle plate 25. As a result, in the case of the conventional seal plate 31, the contact thin plate 35 may be greatly separated from the thin plates 32 other than the contact thin plate 35, and be turned up.

Figure 7:
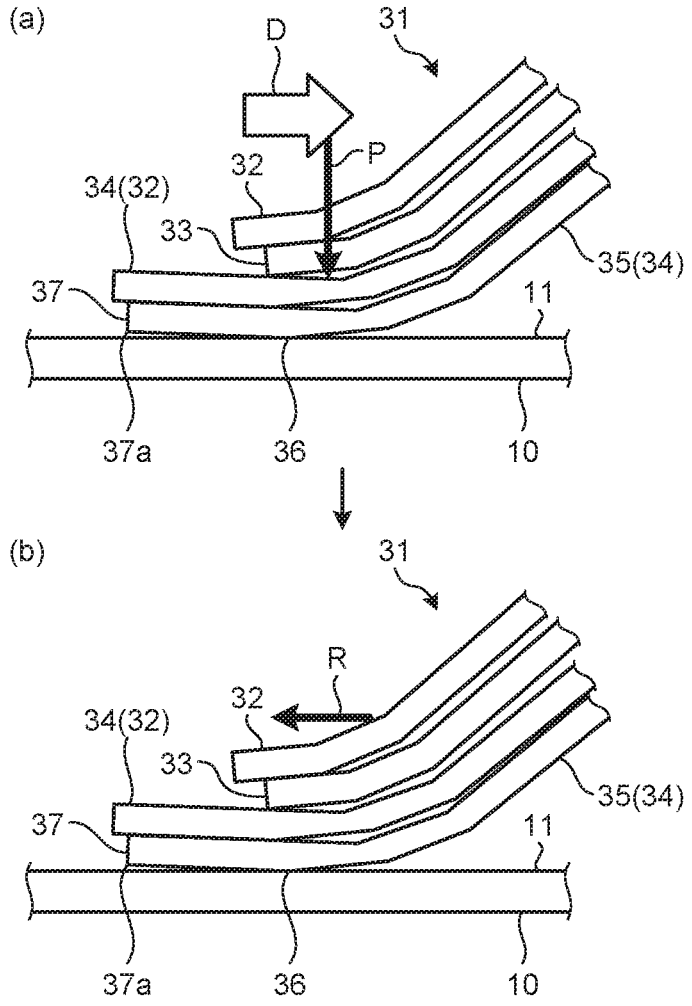
FIG. 7 is a transition diagram illustrating the states of deformation associated with the change in the differential pressure acting on the seal plate according to the first embodiment.

FIG. 7 is a transition diagram illustrating the states of deformation associated with the change in the differential pressure D acting on the seal plate 31 according to the first embodiment. In the seal structure 30 according to the first embodiment, the contact thin plate 35 of the seal plate 31 is formed of the long thin plates 34. Therefore, the outer surface 36 of the contact thin plate 35 makes surface contact with the wall surface 11 of the shell 10 (FIG. 7(*a*)). While the heat exchanger 1 is in operation, when the differential pressure D acts on the seal plate 31 and the differential pressure D generates the pressing force P, the pressing force P acts from the thin plates 32 other than the long thin plates 34 onto a position of the contact thin plate 35 at a distance from the end 37. The pressing force P from the thin plates 32 other than the long thin plates 34 causes the contact thin plate 35 to apply pressing force from the outer surface 36 of the contact thin plate 35 to the wall surface 11 of the shell 10, and the outer surface 36 of the contact thin plate 35 closely contacts with the wall surface 11 near a part of the contact thin plate 35 on which the pressing force P acts from the thin plates 32 other than the long thin plates 34.

To describe it in detail, the pressing force acting on the wall surface 11 from the position on the outer surface 36 at a distance from the end 37 of the contact thin plate 35 is larger than pressing force acting on the wall surface 11 from near the end 37, and the outer surface 36 of the contact thin plate 35 more closely contacts the wall surface 11 near a part of the outer surface 36 where the larger pressing force acts on the wall surface 11. This close contact allows the seal plate 31 to restrain the fluid in the space on the upstream side of the baffle plate 25 from flowing into the space on the downstream side of the baffle plate 25 through the gap 13 between the baffle plate 25 and the wall surface 11.

Stopping the operation of the heat exchanger 1 eliminates the pressure difference between the spaces on both sides separated by the baffle plate 25. As a result, the differential pressure D stops acting also on the seal plate 31, and the restoring force R in the direction from the downstream side to the upstream side is generated in the thin plates 32 (FIG. 7(*b*)). In the first embodiment, the outer surface 36 of the contact thin plate 35 contacts the wall surface 11 of the shell 10, Therefore, when the differential pressure D acts, the contact surface pressure is lower than that in the case where the corner 37*a* of the end 37 of the contact thin plate 35 contacts the wall surface 11 (refer to FIG. 6) as occurring in the case of the conventional seal plate 31. As a result, in the first embodiment, when the restoring force R is generated after the heat exchanger 1 stops operating, the contact thin plate 35 can be easily deformed while sliding with respect to the wall surface 11.

In other words, in the first embodiment, since the outer surface 36 of the contact thin plate 35 makes the surface contact with the wall surface 11 of the shell 10, the corner 37*a* of the end 37 of the contact thin plate 35 is restrained from being caught on the wall surface 11. As a result, when stopping the operation of the heat exchanger 1 has resulted in generating the restoring force R in the seal plate 31, the contact thin plate 35 is deformed in the direction in which the contact thin plate 35 is moved from the downstream side to the upstream side by the restoring force R, and is restored to the original shape before being elastically deformed by the differential pressure D in the same way as the thin plates 32 other than the contact thin plate 35, while the outer surface 36 slides with respect to the wall surface 11 of the shell 10. As described above, the contact thin plate 35 can be deformed while the outer surface 36 slides with respect to the wall surface 11. Therefore, even when the heat exchanger 1 is repeatedly operated and stopped, the contact thin plate 35 continues to apply the pressing force to the wall surface 11 of the shell 10 and makes the outer surface 36 continuously in contact with the wall surface 11 while being repeatedly elastically deformed by the differential pressure D without being greatly separated from the other thin plates 32 to be turned up.

Since the outer surface 36 of the contact thin plate 35 contacts the wall surface 11 on the inner surface side of the shell 10, the seal structure 30 according to the first embodiment described above can restrain the corner 37*a* of the end 37 of the contact thin plate 35 from being caught on the wall surface 11 even when the differential pressure D is large. As a result, even when the differential pressure D repeatedly acts on the seal plate 31 to repeatedly elastically deform the thin plates 32 constituting the seal plate 31, the outer surface 36 of the contact thin plate 35 can be repeatedly elastically deformed in the same way as the other thin plates 32, while sliding on the wall surface 11. Accordingly, the seal plate 31 can continue to ensure the pressing force acting from the outer surface 36 of the contact thin plate 35 onto the wall surface 11 of the shell 10, and the seal late 31 can keep blocking the fluid flowing through the gap 13 between the baffle plate 25 and the wall surface 11 of the shell 10. As a result, the seal performance can be restrained from deteriorating.

Since the contact thin plate 35 is formed of the long thin plates 34, the pressing force P in the direction toward the wall surface 11 is applied from the thin plates 32 other than the contact thin plate 35 into a position other than the end 37. Therefore, the pressing force that acts on the wall surface 11 of the shell 10 from the contact thin plate 35 can more easily act on the wall surface 11 from the position on the outer surface 36 at a distance from the end 37. Consequently, when the differential pressure D repeatedly acts on the seal plate 31, the corner 37*a* of the end 37 of the contact thin plate 35 can be easily restrained from being caught on the wall surface 11, and the contact thin plate 35 can be easily repeatedly elastically deformed. As a result, the seal performance can be easily restrained from deteriorating.

The contact thin plate 35 can be restrained from being turned up. Therefore, vibration strength during the operation of the heat exchanger 1 can be ensured, the vibration strength being strength against vibration occurring when the fluid slightly leaks from between the seal plate 31 and the wall surface 11 of the shell 10. Consequently, the seal plate 31 can be restrained from being damaged by the slight leakage of the fluid. As a result, the seal plate 31 can be improved in durability.

In the heat exchanger 1 according to the first embodiment, the seal structure 30 according to the first embodiment described above closes the gap 13 between the wall surface 11 of the shell 10 and the baffle plate 25. Therefore, even when the operation and the stopping are repeated, the fluid can be continuously restrained from flowing through the gap 13 between the spaces separated by the baffle plate 25. As a result, the seal performance can be restrained from deteriorating.

Second Embodiment

The seal structure 30 according to a second embodiment of the present invention has substantially the same configuration as that of the seal structure 30 according to the first embodiment, but is characterized in that the wall surface 11 of the shell 10 is provided with a convex part 50. Since the other components are the same as those of the first embodiment, they will not be described, and are denoted by the same reference numerals.

Figure 8:
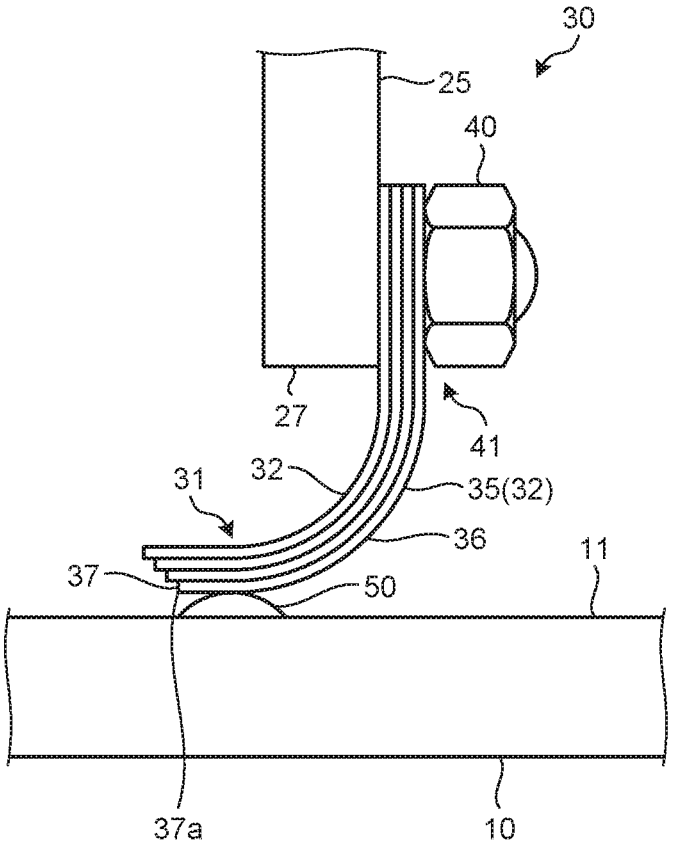
FIG. 8 is a main part sectional view of a seal structure according to a second embodiment of the present invention.

FIG. 8 is a main part sectional view of the seal structure 30 according to the second embodiment. In the seal structure 30 according to the second embodiment, the seal plate 31 laminated with the thin plates 32 is mounted on the baffle plate 25 in the same way as in the seal structure 30 according to the first embodiment, and, unlike the first embodiment, all the thin plates 32 have the same length. In other words, the contact thin plate 35 serving as one of the thin plates 32 located on the outermost side of the curve has the same length as that of the other thin plates 32.

In the second embodiment, the wall surface 11 on the inner surface side of the shell 10 is provided with the convex part 50 projecting from the wall surface 11. In the second embodiment, the convex part 50 projects in a smooth hill-like shape from the wall surface 11 in a sectional view of the shell 10 along the longitudinal direction of the shell 10. The convex part 50 constitutes a part of the wall surface 11. The position of the convex part 50 is disposed near a position in the longitudinal direction of the shell 10 where the seal plate 31 is disposed, and is disposed at least in a range on a circumference of the wall surface 11 where the seal plate 31 is disposed. In other words, the convex part 50 is continuously formed at least in the range on the circumference of the wall surface 11 in which the seal plate 31 is disposed. The outer surface 36 of the contact thin plate 35 of the seal plate 31 mounted on the baffle plate 25 is in contact with the convex part 50 in a position at a distance from the end 37 of the contact thin plate 35. As a result, in the state in which the outer surface 36 of the contact thin plate 35 is in contact with the convex part 50 of the wall surface 11, an end of the end 37 of the contact thin plate 35 is separated from the wall surface 11.

In the seal structure 30 according to the second embodiment, when the differential pressure D generates the pressing force P to press the thin plates 32 in the direction toward the wall surface 11 while the heat exchanger 1 is in operation, the pressing force caused by the pressing force P to act on the wall surface 11 of the shell 10 from the contact thin plate 35 acts on the convex part 50 on the wall surface 11 contacted by the outer surface 36 of the contact thin plate 35. As a result, the outer surface 36 of the contact thin plate 35 closely contacts the convex part 50, so that the seal plate 31 can block the fluid flowing through the gap 13 between the baffle plate 25 and the wall surface 11.

The end 37 of the contact thin plate 35 is separated from the wall surface 11 of the shell 10. Therefore, even when the pressing force P generated in the thin plates 32 large because of the large differential pressure D, the corner 37*a* of the end 37 of the contact thin plate 35 can be restrained from being caught on the wall surface 11. In other words, the outer surface 36 of the contact thin plate 35 contacts the convex part 50 at surface pressure lower than that generated when the corner 37*a* of the end 37 contacts the wall surface 11. Therefore, the outer surface 36 is restrained from being caught on the convex part 50. As a result, when the heat exchanger 1 has stopped operating, the contact thin plate 35 can be deformed in the direction in which the contact thin plate 35 is moved from the downstream side to the upstream side by the restoring force R while the outer surface 36 slides with respect to the convex part 50, and can be restored to the original shape before being elastically deformed by the differential pressure D.

As a result, the contact thin plate 35 can continue to apply the pressing force to the convex part 50 while being repeatedly elastically deformed by the differential pressure D without being greatly separated from the other thin plates 32 to be turned up even when the heat exchanger 1 is repeatedly operated and stopped. Accordingly, the seal plate 31 can continue to ensure the pressing force acting from the outer surface 36 of the contact thin plate 35 onto the wall surface 11 of the shell 10, and can block the flow of the fluid flow through the gap 13 between the baffle plate 25 and the wall surface 11 of the shell 10. As a result, the seal performance can be restrained from deteriorating.

Third Embodiment

The seal structure 30 according to a third embodiment of the present invention has substantially the same configuration as that of the seal structure 30 according to the first embodiment, but is characterized in that a concave part 60 is formed on the wall surface 11 of the shell 10. Since the other components are the same as those of the first embodiment, they will not be described, and are denoted by the same reference numerals.

Figure 9:
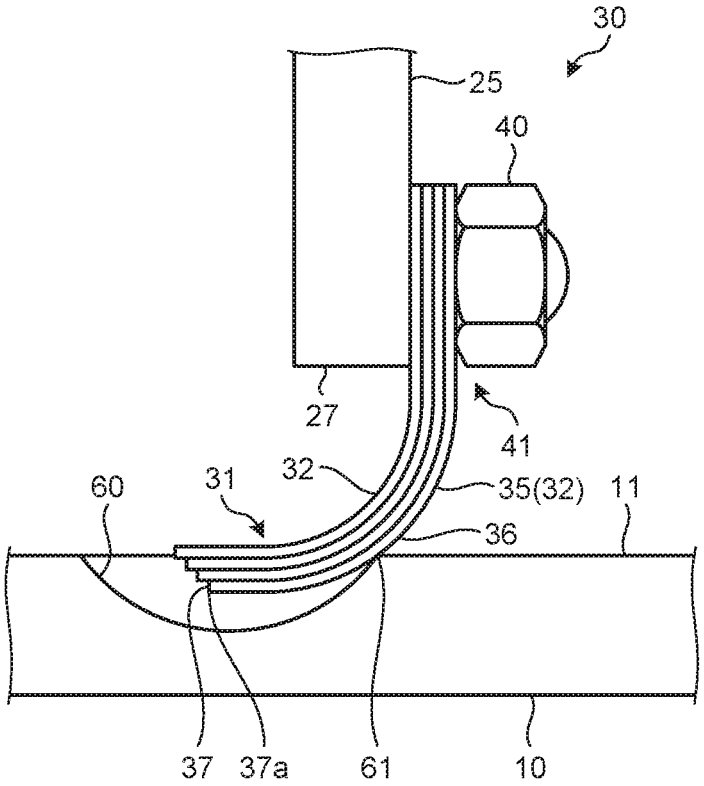
FIG. 9 is a main part sectional view of the seal structure according to a third embodiment of the present invention.

FIG. 9 is a main part sectional view of the seal structure 30 according to the third embodiment. In the seal structure 30 according to the third embodiment, the seal plate 31 laminated with the thin plates 32 is mounted on the baffle plate 25 in the same way as in the seal structure 30 according to the first embodiment, and all the thin plates 32 have the same length in the same way as in the second embodiment. Consequently, the contact thin plate 35 serving as one of the thin plates 32 located on the outermost side of the curve has the same length as that of the other thin plates 32.

In the third embodiment, the concave part 60 recessed from the wall surface 11 is formed on the wall surface 11 on the inner surface side of the shell 10. The concave part 60 is formed near a position in the longitudinal direction of the shell 10 where the seal plate 31 is disposed, and is formed at least in a range on the circumference of the wall surface 11 where the seal plate 31 is disposed. In other words, the concave part 60 is continuously formed in a groove shape extending in the circumferential direction of the wall surface 11 at least in the range on the circumference of the wall surface 11 in which the seal plate 31 is disposed.

The end 37 of the contact thin plate 35 of the seal plate 31 mounted on the baffle plate 25 is located in the concave part 60, so that the outer surface 36 of the contact thin plate 35 is in contact with the wall surface 11 in a position at a distance from the end 37 of the contact thin plate 35. In other words, the end 37 of the contact thin plate 35 is located in the concave part 60, and at the same time, the outer surface 36 of the contact thin plate 35 is in contact with a peripheral end 61 of the concave part 60. This configuration separates the corner 37*a* of the end 37 of the contact thin plate 35 from the wall surface 11.

In the seal structure 30 according to the third embodiment, when the differential pressure D generates the pressing force P to press the thin plates 32 in the direction toward the wall surface 11 while the heat exchanger 1 is in operation, the pressing force caused by the pressing force P to act on the wall surface 11 or the shell 10 from the contact thin plate 35 acts on a position of the peripheral end 61 of the concave part 60 contacted by the outer surface 36 of the contact thin plate 35. As a result, the outer surface 36 of the contact thin plate 35 closely contacts the peripheral end 61 of the concave part 60, so that the seal plate 31 can block the fluid flowing through the gap 13 between the baffle plate 25 and the wall surface 11.

The corner 37*a* of the end 37 of the contact thin plate 35 is separated from the wall surface 11 of the shell 10. Therefore, even when the pressing force P generated in the thin plates 32 is large because of the large differential pressure D, the corner 37*a* of the end 37 of the contact thin plate 35 can be restrained from being caught on the wall surface 11. In other words, the outer surface 36 of the contact thin plate 35 contacts the peripheral end 61 of the concave part 60 at surface pressure lower than that generated when the corner 37*a* of the end 37 contacts the wall surface 11. Therefore, the outer surface 36 is restrained from being caught on the peripheral end 61 of the concave part 60. As a result, when the heat exchanger 1 has stopped operating, the contact thin plate 35 can be deformed in the direction in which the contact thin plate 35 is moved from the downstream side to the upstream side by the restoring force R while the outer surface 36 slides with respect to the peripheral end 61 of the concave part 60, and can be restored to the original shape before being elastically deformed by the differential pressure D. To ensure ease of slip of the outer surface 36, the peripheral end 61 of the concave part 60 is preferably provided with a chamfer, such as a round chamfer.

As a result, the contact thin plate 35 can continue to apply the pressing force to the peripheral end 61 of the concave part 60 while being repeatedly elastically deformed by the differential pressure D without being greatly separated from the other thin plates 32 to be turned up even when the heat exchanger 1 is repeatedly operated and stopped. Accordingly, the seal plate 31 can continue to ensure the pressing force acting from the outer surface 36 of the contact thin plate 35 onto the wall surface 11 of the shell 10, and can block the flow of the fluid flowing through the gap 13 between the baffle plate 25 and the wall surface 11 of the shell 10. As a result, the seal performance can be restrained from deteriorating.

Fourth Embodiment

The seal structure 30 according to a fourth embodiment of the present invention has substantially the same configuration as that of the seal structure 30 according to the first embodiment, but is characterized in that the contact thin plate 35 of the seal plate 31 is folded back. Since the other components are the same as those of the first embodiment, they will not be described, and are denoted by the same reference numerals.

Figure 10:
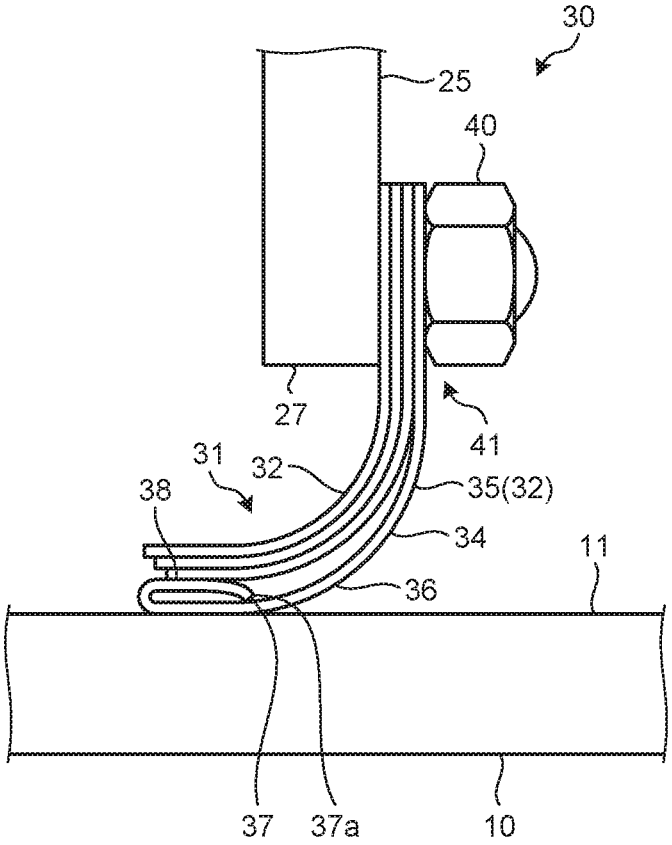
FIG. 10 is a main part sectional view of the seal structure according to a fourth embodiment of the present invention.

FIG. 10 is a main part sectional view of the seal structure 30 according to the fourth embodiment. In the seal structure 30 according to the fourth embodiment, the seal plate 31 laminated with the thin plates 32 is mounted on the baffle plate 25 in the same way as in the seal structure 30 according to the first embodiment, and the contact thin plate 35 serving as one of the thin plates 32 located on the outermost side of the curve is the long thin plate 39 having a longer length than that of the other thin plates 32. Unlike the first embodiment, the contact thin plate 35 constituted by the long thin plate 34 is provided with a folded part 38.

To describe it in detail, a predetermined range on the end 37 side of the contact thin plate 35 is folded back toward a side opposite to a side where the outer surface 36 is located so as to form the folded part 38. As a result, when the contact thin plate 35 contacts the wall surface 11, the outer surface 36 contacts the wall surface 11 in a position at a distance from the corner 37*a* of the end 37. The outer surface 36 contacts the wall surface 11 over an area larger than that when the corner 37*a* of the end 37 of the contact thin plate 35 contacts the wall surface 11. Therefore, the outer surface 36 contacts the wall surface 11 at surface pressure lower than that when the corner 37*a* of the end 37 contacts the wall surface 11.

In the seal structure 30 according to the fourth embodiment, when the differential pressure D generates the pressing force P to press the thin plates 32 in the direction toward the wall surface 11 while the heat exchanger 1 is in operation, the pressing force caused by the pressing force P to act on the wall surface 11 of the shell 10 from the contact thin plate 35 acts on a part of the contact between the outer surface 36 of the contact thin plate 35 and the wall surface 11. As a result, the outer surface 36 of the contact thin plate 35 closely contacts the wall surface 11, so that the seal plate 31 can block the fluid flowing through the gap 13 between the baffle plate 25 and the wall surface 11.

The formation of the folded part 38 separates the corner 37*a* of the end 37 of the contact thin plate 35 from the wall surface 11 of the shell 10. Therefore, even when the pressing force P generated in the thin plates 32 is large because of the large differential pressure D, the corner 37*a* of the end 37 of the contact thin plate 35 can be restrained from being caught on the wall surface 11. In other words, the outer surface 36 of the contact thin plate 35 contacts the wall surface 11 at surface pressure lower than that generated when the corner 37*a* of the end 37 contacts the wall surface 11. Therefore, the outer surface 36 is restrained from being caught on the wall surface 11. As a result, when the heat exchanger 1 has stopped operating, the contact thin plate 35 can be deformed in the direction in which the contact thin plate 35 is moved from the downstream side to the upstream side by the restoring force R while the outer surface 36 slides with respect to the wall surface 11 of the shell 10, and can be restored to the original shape before being elastically deformed by the differential pressure D.

As a result, the contact thin plate 35 can continue to apply the pressing force to the wall surface 11 of the shell 10 while being repeatedly elastically deformed by the differential pressure D without being greatly separated from the other thin plates 32 to be turned up even when the heat exchanger 1 is repeatedly operated and stopped. Accordingly, the seal plate 31 can continue to ensure the pressing force acting from the outer surface 36 of the contact thin plate 35 onto the wall surface 11, and can block the flow of the fluid flowing through the gap 13 between the baffle plate 25 and the wall surface 11 of the shell 10. As a result, the seal performance can be restrained from deteriorating.

Fifth Embodiment

The seal structure 30 according to a fifth embodiment of the present invention has substantially the same configuration as that of the seal structure 30 according to the first embodiment, but is characterized in that a deformation restraining plate 70 is disposed. Since the other components are the same as those of the first embodiment, they will not be described, and are denoted by the same reference numerals.

Figure 11:
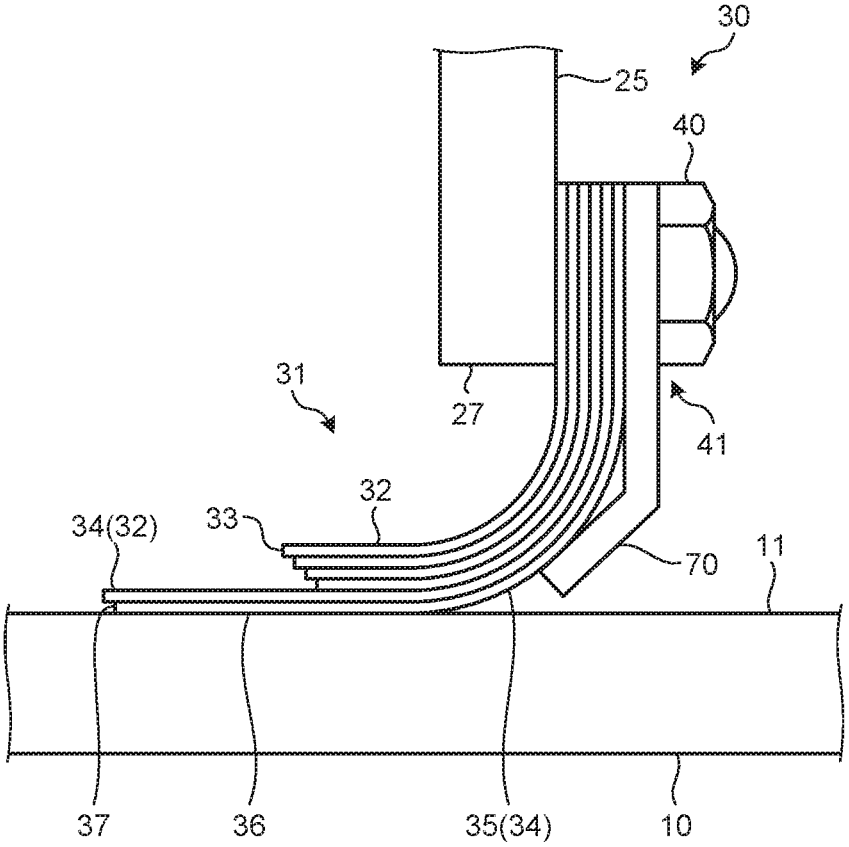
FIG. 11 is a main part sectional view of the seal structure according to a fifth embodiment of the present invention.

FIG. 11 is a main part sectional view of the seal structure 30 according to the fifth embodiment. In the seal structure 30 according to the fifth embodiment, in the same way as in the seal structure 30 according to the first embodiment, the seal plate 31 laminated with the thin plates 32 is mounted on the baffle plate 25, and the contact thin plate 35 serving as one of the thin plates 32 located on the outermost side of the curve is composed of the long thin plates 34.

In addition, in the fifth embodiment, the deformation restraining plate 70 is mounted on the seal plate 31 so as to be laminated on the outer surface 36 side of the contact thin plate 35, the deformation restraining plate 70 being a deformation restraining member that restricts the seal plate 31 from being deformed toward the outside direction of the curve. The deformation restraining plate 70 is a plate-shaped member made of a metal material thicker than the thin plate 32, and is higher in stiffness than the thin plate 32. In the same way as in the thin plates 32, through-holes (not illustrated) are formed in the deformation restraining plate 70 to pass the bolts 40 therethrough, and the deformation restraining plate 70 is laminated on the thin plates 32 and mounted on the baffle plate 25 by the bolts 40 together with the thin plates 32. The deformation restraining plate 70 is formed from the tightened part 41 toward the wall surface 11 of the shell 10 in the same way as the thin plates 32, but is not in contact with the wall surface 11.

As described above, in the fifth embodiment, the deformation restraining plate 70 is mounted on the outer surface 36 of the contact thin plate 35 so as to be laminated on the thin plates 32. As a result, even when the differential pressure D is generated while the heat exchanger is in operation, the thin plates 32 are restricted from being deformed toward the outside direction of the curve, in other words, restricted from being deformed in the direction in which the differential pressure ID acts. This restriction also restricts the contact thin plate 35 from being deformed in the direction in which the differential pressure D acts. Therefore, the contact thin plate 35 can be more reliably restrained from being greatly separated from the other thin plates 32 to be turned up even when the heat exchanger 1 is repeatedly operated and stopped. Accordingly, the seal plate 31 can more reliably continue to ensure the pressing force between the outer surface 36 of the contact thin plate 35 and the wall surface 11, and can block the flow of the fluid flowing through the gap 13 between the baffle plate 25 and the wall surface 11 of the shell 10. As a result, the seal performance can be more reliably restrained from deteriorating.

Sixth Embodiment

The seal structure 30 according to a sixth embodiment of the present invention has substantially the same configuration as that of the seal structure 30 according to the first embodiment, but is characterized in that the seal plate 31 extends so as to be curved toward both sides in the direction of flow of the fluid. Since the other components are the same as those of the first embodiment, they will not be described, and are denoted by the same reference numerals.

Figure 12:
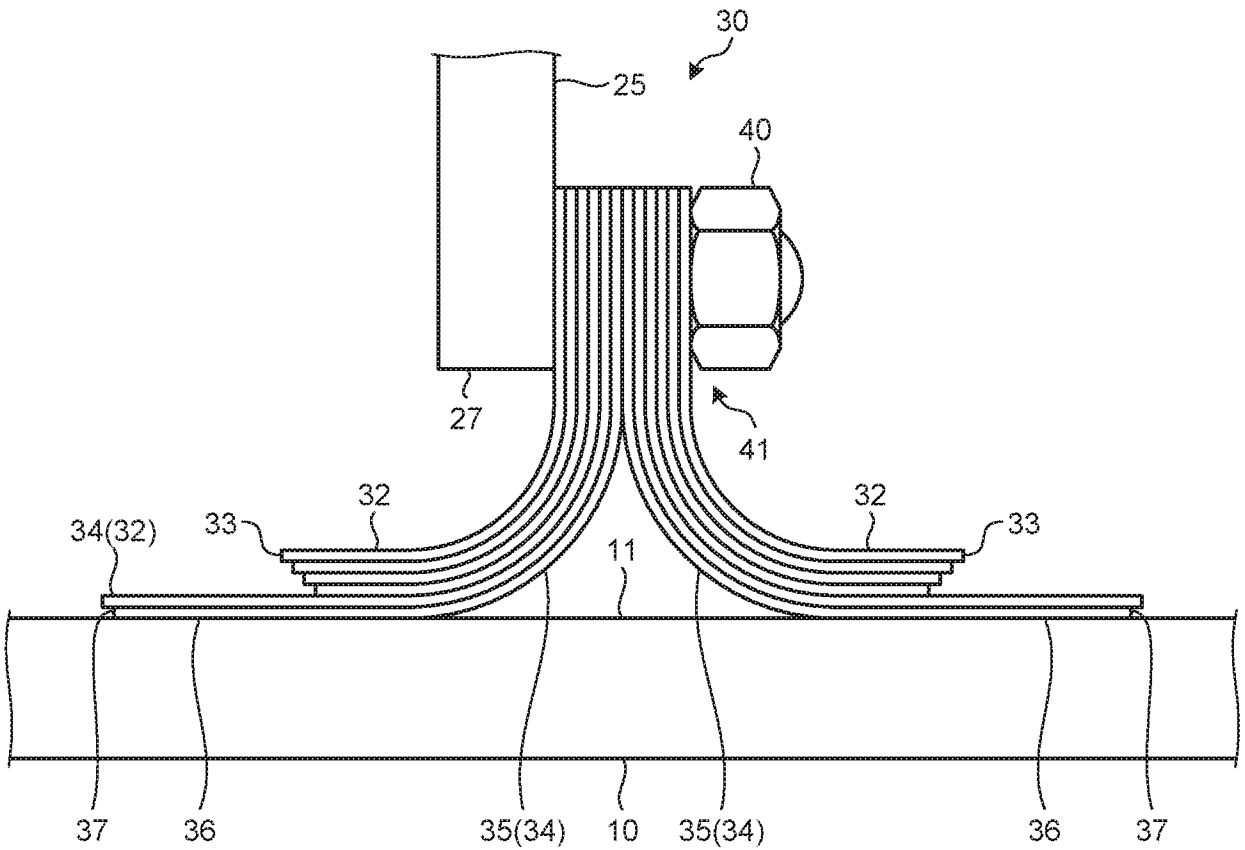
FIG. 12 is a main part sectional view of the seal structure according to a sixth embodiment of the present invention.

FIG. 12 is a main part sectional view of the seal structure 30 according to the sixth embodiment. In the seal structure 30 according to the sixth embodiment, in the same wav as in the seal structure 30 according to the first embodiment, the seal plate 31 laminated with the thin plates 32 is mounted on the baffle plate 25, and the contact thin plate 35 serving as one of the thin plates 32 located on the outermost side of the curve is composed of the long thin plates 34.

In addition, in the sixth embodiment, the seal plate 31 is curved toward both the upstream and downstream side spaces separated by the baffle plate 25. In the seal plate 31, among both the thin plates 32 curved toward the upstream side and the thin plates 32 curved toward the downstream side, the contact thin plates 35 in contact with the wall surface 11 of the shell 10 are each formed of the long thin plates 34. As a result, when the laminated thin plates 32 are viewed as a whole, the contact thin plate 35 on the upstream side and the contact thin plate 35 on the downstream side of the seal plate 31 are disposed near the center of the laminated thin plates 32. In other words, in the seal structure 30 according to the sixth embodiment, both the thin plates 32 on the upstream side and the thin plates 32 on the downstream side have the same configuration as that of the seal plate 31 of the first embodiment.

As described above, in the sixth embodiment, the seal plate 31 is curved toward both the upstream and downstream side spaces separated by the baffle plate 25. Therefore, the seal plate 31 can block the flow of the fluid in both directions between the spaces separated by the baffle plate 25. As a result, even when a relative relation of the pressure between the spaces separated by the baffle plate 25 temporarily changes while the heat exchanger 1 is in operation, the seal plate 31 can block the flow of the fluid flowing through the gap 13 between the baffle plate 25 and the wall surface 11 of the shell 10 caused by the pressure difference.

Since both the thin plates 32 on the upstream side and the thin plates 32 on the downstream side have the same configuration as that of the seal plate 31 of the first embodiment, the contact thin plate 35 can be restrained from being greatly separated from the other thin plates 32 to be turned up, regardless of the state of the relative relation of the pressure while the heat exchanger 1 is in operation. As a result, the seal performance can be more reliably restrained from deteriorating.

Modifications

In the first to fifth embodiments described above, the seal plate 31 is mounted in the range on the part of the circumference of the circumferential part 27 of the baffle plate 25.

The seal plate 31 may, however, be mounted in the whole range on the circumference of the circumferential part 27 of the baffle plate 25. In other words, the seal plate 31 may be disposed in the whole range in which the gap 13 between the seal plate 31 and the wall surface 11 of the shell 10 is formed. The range for disposing the seal plate 31 therein is preferably set taking into consideration, for example, the required performance and manufacturing cost of the heat exchanger 1.

In the second embodiment described above, the convex part 50 is disposed in the range on the circumference of the wall surface 11 in which the seal plate 31 is disposed. The convex part 50 may, however, be provided in another range. The convex part 50 may be disposed, for example, over the full circle of the wall surface 11. In the same way, in the third embodiment described above, the concave part 60 is formed in the range on the circumference of the wall surface 11 in which the seal plate 31 is disposed. The concave part 60 may, however, be formed in another range. The concave part 60 may be formed, for example, over the full circle of the wall surface 11.

In the fifth embodiment described above, the deformation restraining plate 70 is provided on the seal plate 31 having the same configuration as that of the first embodiment. However, the seal plate 31 provided with the deformation restraining plate 70 may be other than the seal plate 31 having the same configuration as that of the first embodiment. The seal plate 31 provided with the deformation restraining plate 70 may be the seal plate 31 having the same configuration as that of any one of the second to fourth embodiments.

The first to sixth embodiments and the modifications thereof may be combined as appropriate. For example, the convex part 50 of the second embodiment may be provided on the wall surface 11 contacted by the seal plate 31 of the first embodiment, or the concave part 60 of the third embodiment may be formed on the wall surface 11 contacted by the seal plate 31 of the fourth embodiment. In the sixth embodiment, the thin plates 32 being curved toward both the upstream and downstream side spaces separated by the baffle plate 25, the convex part 50, and the concave part 60 may each have a configuration of any one of the first to fourth embodiments, and may have configurations different between the upstream side and the downstream side. Any method of the combination can be used as long as the outer surface 36 of the contact thin plate 35 can contact the wall surface 11 at pressing force, between the outer surface 36 of the contact thin plate 35 and the wall surface 11 of the shell 10, larger than pressing force between the end 37 of the contact thin plate 35 and the wall surface 11.

REFERENCE SIGNS LIST

1 Heat exchanger
10 Shell
11 Wall surface
12 Window part
13 Gap
15 Inlet port
16 Outlet port
20 Heat transfer tube
25 Baffle plate
26 Cut out part
27 Circumferential part
30 Seal structure
31 Seal plate
32 Thin plate
33 End
34 Long thin plate
35 Contact thin plate
36 Outer surface
37 End
37*a* Corner
38 Folded part
40 Bolt
41 Tightened part
50 Convex part
60 Concave part
61 Peripheral end
70 Deformation restraining plate (deformation restraining member)

The invention claimed is:

1. A seal structure of a heat exchanger, the seal structure comprising a seal plate mounted on a baffle plate disposed in a shell included in the heat exchanger, the seal plate being in contact with a wall surface on an inner surface side of the shell, wherein the seal plate is composed of a plurality of thin plates which are laminated, the thin plates are curved by elastic deformation, and the plurality of thin plates includes a contact thin plate located on an outermost side of the curve, the contact thin plate being the only thin plate which is in contact with the wall surface, wherein the contact thin plate has an outer surface and an inner surface on opposite sides of the contact thin plate with respect to a thickness direction of the contact thin plate, wherein the outer surface is a surface on an outside of the curve, the inner surface is a surface on an inside of the curve, and the outer surface is in contact with the wall surface, and wherein a longitudinal end of the contact thin plate is configured to not come in contact with the wall surface, and wherein the contact thin plate further comprises a folded part in which a portion of the contact thin plate including the longitudinal end of the contact thin plate is folded back toward the inner surface of a non-folded part of the contact thin plate such that the outer surface of the portion of the contact thin plate forming the folded part directly contacts a thin plate of the plurality of thin plates which is immediately adjacent to the contact thin plate.

2. The seal structure of a heat exchanger according to claim 1, wherein the wall surface is provided with a convex part projecting from the wall surface, and the outer surface of the contact thin plate of the seal plate is in contact with the convex part.

3. The seal structure of a heat exchanger according to claim 1, wherein a concave part recessed from the wall surface is formed on the wall surface, and the outer surface of the contact thin plate of the seal plate is in contact with a peripheral end of the concave part.

4. The seal structure of a heat exchanger according to claim 1, wherein a deformation restraining member configured to restrict the contact thin plate from being deformed toward the outside direction of the curve is laminated and mounted on the outer surface side of the contact thin plate of the seal plate.

5. A heat exchanger comprising:

the seal structure according to claim 1 that is mounted on the baffle plate and closes a gap between a wall surface of the shell and the baffle plate in the shell;

the baffle plate; and the shell in which the baffle plate is disposed.

6. The seal structure of a heat exchanger according to claim 1, wherein a length from a mounting position of the seal plate onto the baffle plate to the longitudinal end of the contact thin plate is longer than a length from the mounting position onto the baffle plate to a longitudinal end of each of at least some of the thin plates other than the contact thin plate, and a pressing force in a direction toward the wall surface is applied from the thin plates other than the contact thin plate into a position other than the longitudinal end of the contact thin plate.

* * * * *